US009370061B1

(12) United States Patent
Xiong

(10) Patent No.: US 9,370,061 B1
(45) Date of Patent: Jun. 14, 2016

(54) HIGH POWER FACTOR CONSTANT CURRENT BUCK-BOOST POWER CONVERTER WITH FLOATING IC DRIVER CONTROL

(71) Applicant: Universal Lighting Technologies, Inc., Madison, AL (US)

(72) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/624,770

(22) Filed: Feb. 18, 2015

Related U.S. Application Data

(60) Provisional application No. 62/038,686, filed on Aug. 18, 2014.

(51) Int. Cl.
*H05B 33/08* (2006.01)
*H05B 37/02* (2006.01)

(52) U.S. Cl.
CPC ..... *H05B 33/0815* (2013.01)

(58) Field of Classification Search
CPC ... H02M 3/1582; H02M 3/158; H02M 3/156; H02M 1/14; H02M 2001/0006; H05B 33/0815; H05B 33/0809; H05B 33/0824; H05B 33/0896
See application file for complete search history.

(56) References Cited

U.S. PATENT DOCUMENTS

| | | | | |
|---|---|---|---|---|
| 8,305,004 | B2 | 11/2012 | Shao | |
| 8,432,109 | B2 | 4/2013 | Yang et al. | |
| 2011/0304276 | A1 | 12/2011 | Hariharan | |
| 2012/0268023 | A1 * | 10/2012 | Yan | H05B 33/0815 315/200 R |

* cited by examiner

*Primary Examiner* — Jany Richardson
(74) *Attorney, Agent, or Firm* — Patterson Intellectual Property Law, P.C.; Mark J. Patterson; Gary L. Montle

(57) ABSTRACT

A high power factor, constant current, buck-boost LED driver circuit is provided with floating IC driving control. A DC power supply is provided with a first input and a second input that is coupled to a mains ground. A switching circuit is coupled to receive the first input and to convert input power into a constant current supply for an LED load. A current sensor is coupled to the switching circuit and configured to provide feedback signals representative of a current through the LED load, and a controller is coupled to the switching circuit and the current sensor and configured to provide driver signals to the switching circuit based at least in part on the feedback signal. Each of the switching circuit, the current sensor and the controller are commonly coupled to a floating circuit ground. A buck-boost inductor is further coupled between the floating ground and mains circuit ground.

10 Claims, 3 Drawing Sheets

HIGH POWER FACTOR CONSTANT CURRENT BUCK-BOOST POWER CONVERTER WITH FLOATING IC DRIVER CONTROL

CROSS-REFERENCES TO RELATED APPLICATIONS

This application claims benefit of U.S. Provisional Patent Application No. 62/038,686, filed Aug. 18, 2014, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present disclosure relates generally to power converters. More particularly, an invention as disclosed herein relates to high power factor, constant current buck-boost converters. Still more particularly, circuitry as disclosed herein is designed to reduce the cost and size of non-isolated constant current LED drivers as conventionally known in the art.

Buck-boost converters are conventionally very good candidates for use with wide range input voltage (120-277V), high power factor, non-isolated constant current LED drivers. Such converters are relatively low in cost and compact in nature. However, a typical topology, as represented for example in FIG. 1, has a drawback in that the output does not share the same ground as the control IC, causing current control to be very complicated.

For a conventional LED driver circuit 10 as shown in FIG. 1, V1 is the input AC source. Inductor L1 is a common mode inductor to reduce electromagnetic interference (EMI). Capacitor C1 is an EMI filter capacitor. Inductor L2 is a differential EMI inductor. Diodes D1-D4 are input rectifier diodes for converting the AC input supply voltage to a DC power supply voltage. Capacitor C2 is a high frequency filter capacitor for the converter. Resistors R1 and R2 define a voltage divider coupled across filtering capacitor C2. Inductor L3 is a buck-boost inductor that stores energy and releases it according to the control of IC. Switch Q1 is a switching element that is controlled by driver signals generated from the controller IC. Diode D5 is a rectifier diode that bypasses the current from the primary winding $L3_p$ of the buck-boost inductor L3 to output capacitor C4 when the switching element Q1 is off.

The controller IC as shown in FIG. 1 typically can be a power factor control (PFC) controller IC as is known in the art, such as for example the L6562 offered by STMicroelectronics. The controller IC has a MULT pin that senses the input line signal via a node between the voltage dividing resistors R1 and R2. The controller IC also has a zero current detection (ZCD) pin that is coupled to a secondary winding $L3_s$ of the buck-boost inductor L3 via resistor R3, wherein the controller IC may ensure transition mode operation by controlling the turn-on time of the switching element Q1. The controller IC also has an $I_{sense}$ pin that senses the current going through the switching element Q1 and resistor R5. The controller IC further includes an internal OPAMP with a $V_{sense}$ input and COMP as output. Capacitor C3 is an integration capacitor for the control loop.

Typically, there is an internal voltage reference in the controller IC which is used as a control reference. The controller IC compares this internal reference with the external $V_{sense}$ signal to tightly control the output. For constant current control, $V_{sense}$ needs to be a current feedback signal that comes from the load.

However, the controller IC does not share the same ground as the output load, as shown in FIG. 1. As a result, an expensive isolated signal coupler is typically required to transfer the real current sensing signal from the output stage to the IC stage. Resistor R6 is the load current sensing resistor.

This isolated signal coupler is not only expensive, but also introduces error and complicates the control scheme. Therefore, it would be desirable to eliminate this type of isolated signal coupler in a buck-boost converter topology.

BRIEF SUMMARY OF THE INVENTION

The floating IC driven buck boost converter presented in this disclosure will effectively solve this problem. The floating IC driven high power factor constant current buck-boost converter has a very compact size, a simple control scheme, an extremely low cost and high efficiency.

In one embodiment, a buck-boost LED driver circuit as disclosed herein includes a DC power supply with a first input and a second input that is coupled to a mains ground. A switching circuit is coupled to receive the first input and to convert input power into a constant current supply for an LED load. A current sensor is coupled to the switching circuit and is configured to provide feedback signals representative of a current through the LED load. A controller is coupled to the switching circuit and to the current sensor and is configured to provide driver signals to the switching circuit based at least in part on the feedback signal. Each of the switching circuit, the current sensor and the controller are commonly coupled to a floating circuit ground.

A primary winding of a buck-boost inductor is further coupled between the floating ground and mains circuit ground. A secondary winding of the buck-boost inductor is coupled on a first end to the controller for regulating a turn-on time of the switching element, and on a second end to the floating ground.

DETAILED DESCRIPTION OF THE INVENTION

Figure 1:
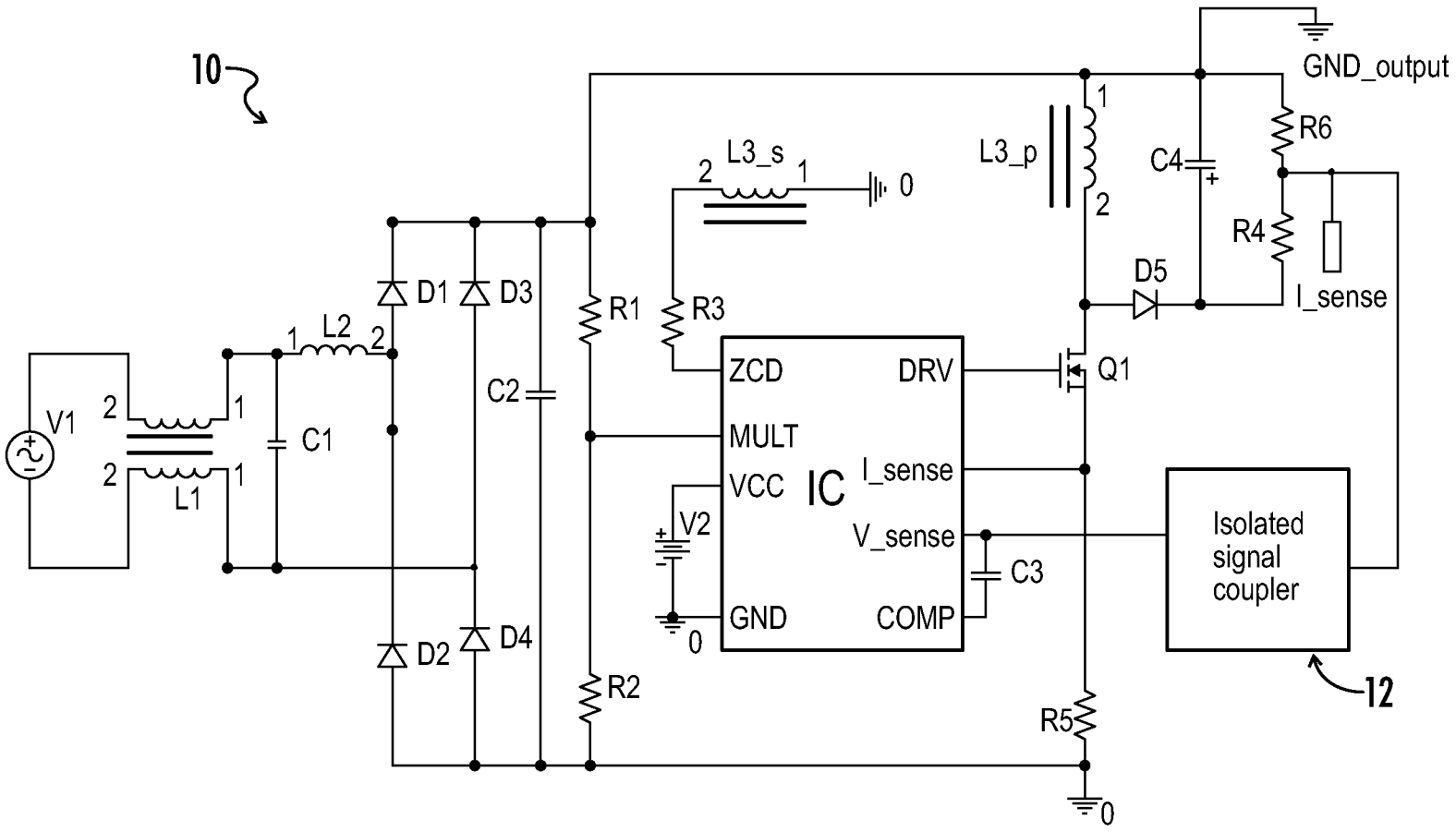
FIG. 1 (PRIOR ART)
FIG. 1 is a circuit block diagram representing a high power factor constant current buck-boost converter as conventionally known in the art.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Figure 2:
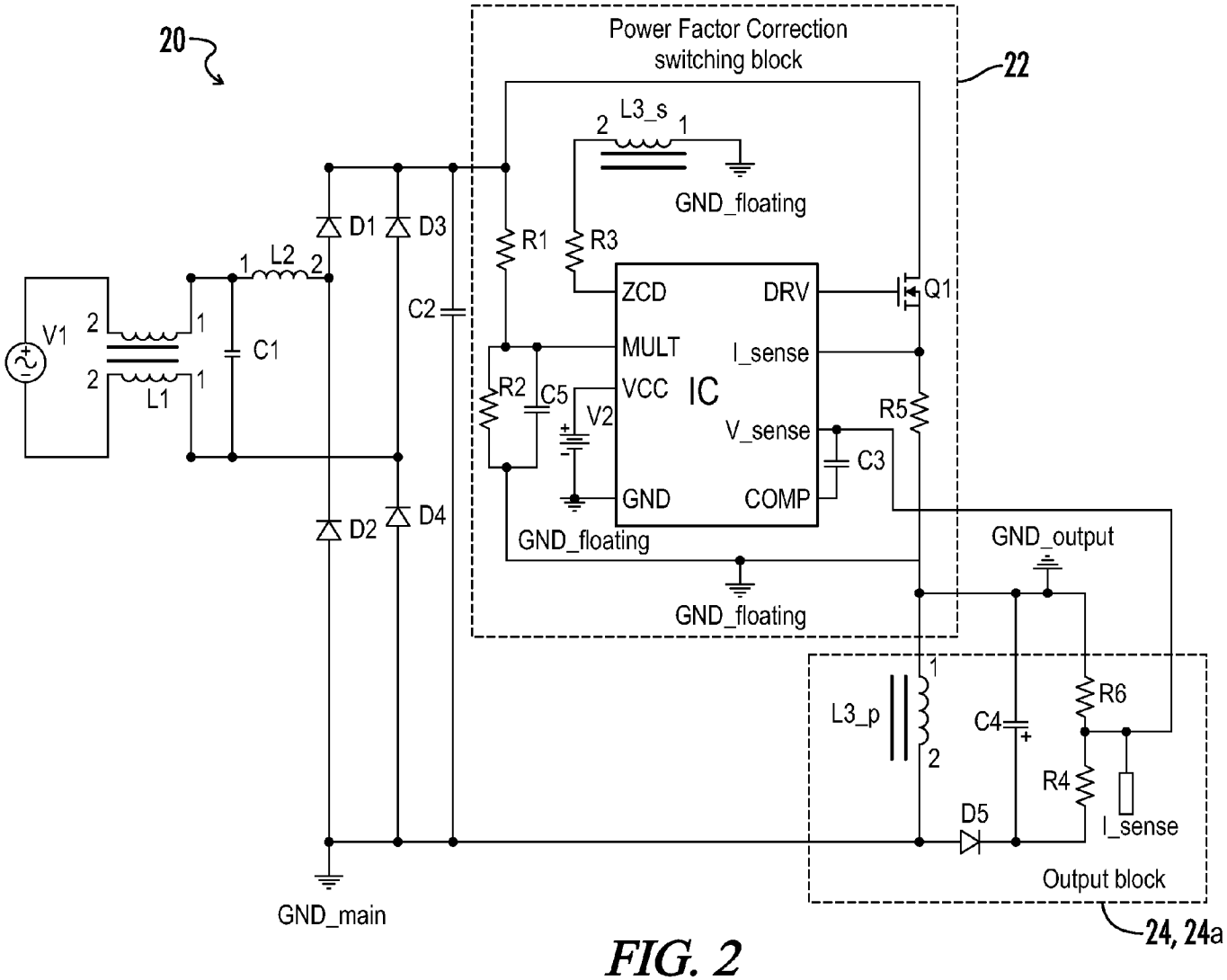
FIG. 2 is a circuit block diagram representing an embodiment of a power converter topology according to the present invention.
Figure 3:
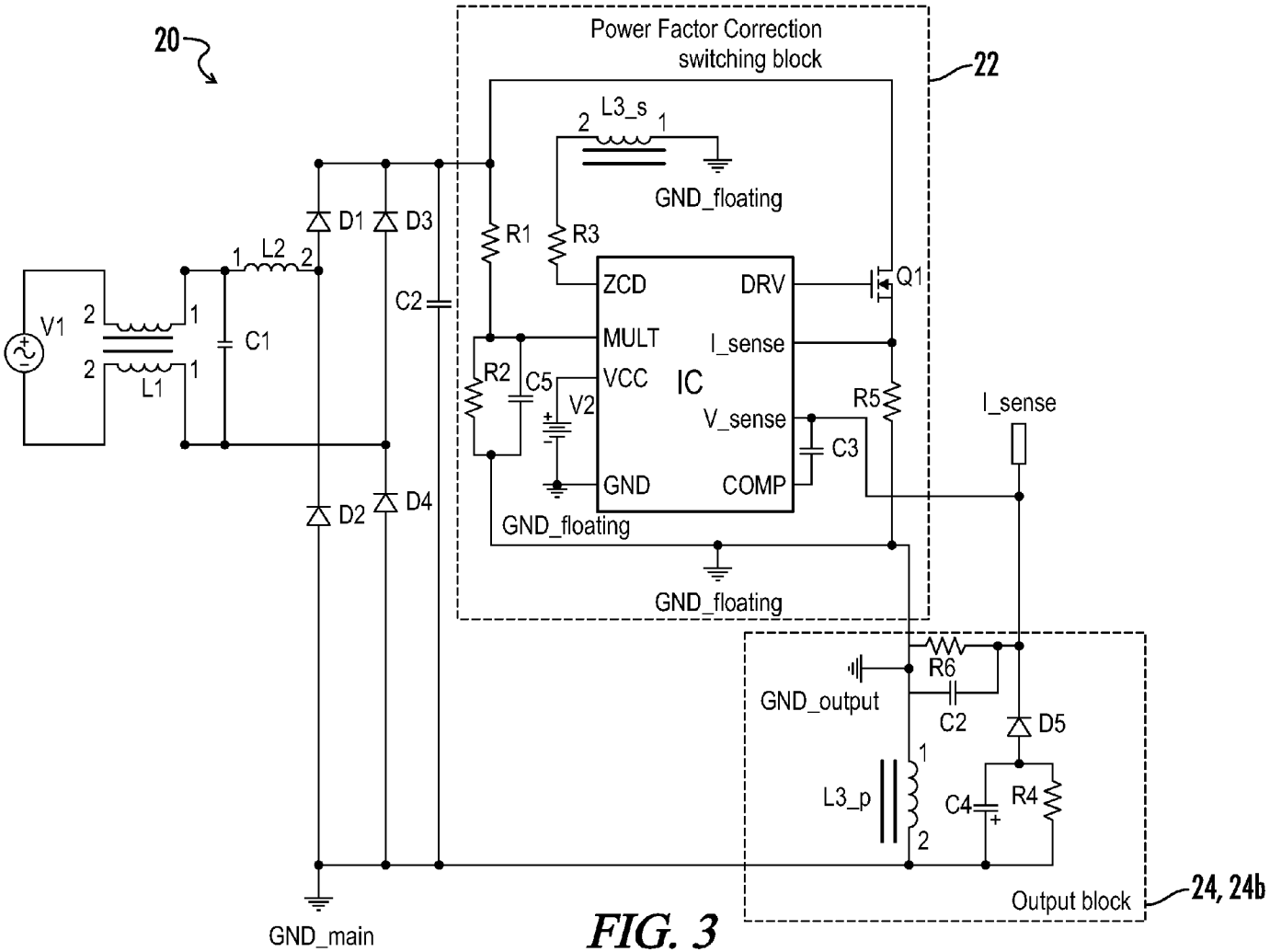
FIG. 3 is a circuit block diagram representing another embodiment of a power converter topology according to the present invention.

Referring generally to FIGS. 2 and 3, various embodiments of an LED driver circuit 20 as disclosed herein include an output block 24 which is rearranged so that it shares the same ground as a power factor correction (PFC) switching block 22. Where the various figures may describe embodiments sharing various common elements and features with other embodiments, similar elements and features are given the same reference numerals and redundant description thereof may be omitted below.

Referring more particularly to FIG. 2, an LED driver 20 includes a PFC switching block 22 which has its own floating ground $GND_{floating}$. The entire output block 24*a* is connected in series with resistor R5 and switching element Q1, and has its own ground $GND_{output}$. However, electrically speaking $GND_{floating}$ and $GND_{output}$ are the same point.

Because the PFC switching block 22 and output block 24*a* share the same ground, the output current sensing signal $I_{sense}$ can be used to directly feedback to the controller IC for current regulation. No isolated signal coupler is needed for constant current control and the controller IC operations will be extremely simplified.

To ensure that the power factor correction controller IC functions correctly, the average voltage between controller IC ground ($GND_{floating}$) and mains ground ($GND_{main}$) must be zero in steady state, so that the low frequency voltage (input line frequency) at MULT pin (multiplier pin of power factor correction controller IC) is effectively proportional to the output of the input diode bridge rectifier defined by diodes D1-D4. The controller IC can therefore regulate the input current to follow the input voltage waveform to achieve its power factor correction goal.

Because the DC resistance is very small for a magnetic component, the DC voltage across the primary winding $L3_p$ of the buck-boost inductor L3 is zero in steady state operation. Therefore, the requirement discussed above (i.e., zero voltage across the controller IC ground and the mains ground) is satisfied in the exemplary circuit shown in both of FIGS. 2 and 3.

However, the high frequency voltage and the output voltage of the input diode rectifier bridge D1-D4 are superposed across resistors R1 and R2. To filter out the high frequency noise across resistor R2, a high frequency noise filter capacitor C5 is connected in parallel with resistor R2 to filter out the high frequency noise coming from the primary winding $L3_p$ of the buck-boost inductor.

Referring next to an alternative topology for an LED driver 20 as represented in FIG. 3, the primary difference is that the current sensing position in the exemplary output block 24*b* shown is different. The current sensing signal in FIG. 2 is the real current signal, but the output is floating. The current sensing signal in FIG. 3 is the total current passing through the diode D5, but the AC current component is filtered out by capacitor C2 which is coupled in parallel with the sensing resistor R6, so that the DC component will be the same as the current going through the LED load R4.

One advantage for the topology represented in FIG. 3 is that the output has a reference point, which is the input diode bridge ground, $GND_{main}$. This topology could offer a better output current waveform and EMI result.

The previous detailed description has been provided for the purposes of illustration and description. Thus, although there have been described particular embodiments of an invention, it is not intended that such references be construed as limitations upon the scope of this invention except as set forth in the following claims.

What is claimed is:

1. An LED driver circuit comprising:

first and second DC input terminals, the second DC input terminal coupled to a first circuit ground;

a switching circuit block comprising a switching element having first and second power terminals coupled on a first end to the first DC input terminal and on a second end to a second circuit ground; and an output circuit block comprising a buck-boost inductor coupled on a first end to the first circuit ground and on a second end to the second circuit ground, a current sensor coupled on a first end to the second circuit ground and on a second end directly to a feedback input terminal on the controller, and a capacitor coupled in parallel with the current sensor, wherein an AC current component is filtered from a feedback current signal;

wherein the switching element is configured to drive an LED load coupled between the second circuit ground and the feedback input terminal on the controller with a substantially constant current based on driving signals provided to a control terminal from a controller.

2. The LED driver circuit of claim 1, the controller configured to compare a feedback current signal from the current sensor to a reference value to generate the driving signals for the switching element.

3. The LED driver circuit of claim 1, the output circuit block further comprising an output capacitor coupled in parallel with a series circuit comprising the LED load and the current sensor.

4. The LED driver circuit of claim 3, the output circuit block further comprising a diode coupled on a first end to the second circuit ground and on a second end to the output capacitor and the LED load.

5. An LED driver circuit comprising:

a switching circuit coupled to receive input power from a DC source associated with a mains circuit ground and to convert the input power into a constant current supply for an LED load;

an inductor coupled in series between the switching circuit and the mains circuit ground, wherein a node between the switching circuit and the inductor is coupled to a floating circuit ground;

a current sensor coupled to the switching circuit and configured to provide feedback signals representative of a current through the LED load;

a capacitor coupled in parallel with the current sensor, wherein an AC current component is filtered from the feedback signals;

a controller coupled to the switching circuit and the current sensor and configured to provide driver signals to the switching circuit based at least in part on the feedback signal; and wherein the LED load is coupled between the mains circuit ground and a node between the current sensor and the controller.

6. The LED driver circuit of claim 5, further comprising an output capacitor coupled in parallel with a series circuit comprising the LED load and the current sensor.

7. The LED driver circuit of claim 6, further comprising a diode coupled on a first end to the floating circuit ground and on a second end to the output capacitor and the LED load.

8. An LED driver circuit comprising:

first and second DC input terminals, the second DC input terminal coupled to a first circuit ground;

a switching circuit block comprising a switching element having first and second power terminals coupled on a first end to the first DC input terminal and on a second end to a second circuit ground, and configured to drive an LED load with a substantially constant current based on driving signals provided to a control terminal from a controller; and an output circuit block comprising a current sensor coupled on a first end to the second circuit ground and on a second end directly to a feedback input terminal on the controller;

a buck-boost inductor coupled on a first end to the first circuit ground and on a second end to the second circuit ground, an output capacitor coupled in parallel with a series circuit comprising the LED load and the current sensor, and a diode coupled on a first end to the second circuit ground and on a second end to the output capacitor and the LED load.

9. The LED driver circuit of claim 8, wherein the controller is configured to compare a feedback current signal from the current sensor to a reference value to generate the driving signals for the switching element.

10. The LED driver of claim 8, the output circuit block further comprising a capacitor coupled in parallel with the current sensor, wherein an AC current component is filtered from the feedback current signal.

* * * * *